United States Patent [19]

Bugarcic

[11] 4,044,687

[45] Aug. 30, 1977

[54] TRUCK FOR THE COMMON PIVOTAL SUPPORT OF TWO CAR BODIES

[75] Inventor: Helmut Bugarcic, Berlin, Germany

[73] Assignee: Linke-Hofmann-Busch GmbH, Germany

[21] Appl. No.: 606,549

[22] Filed: Aug. 21, 1975

[30] Foreign Application Priority Data

Aug. 21, 1974 Germany ..... 2440069

[51] Int. Cl.[2] ..... B61F 5/08

[52] U.S. Cl. ..... 105/4 R; 105/199 CB; 105/201

[58] Field of Search ..... 105/4 R, 199 R, 199 CB, 105/200, 201; 267/3, 4; 308/138

[56] References Cited

U.S. PATENT DOCUMENTS

| | | | |
|---|---|---|---|
| 2,698,208 | 12/1954 | Dilg | 308/138 |
| 2,704,518 | 3/1955 | Buzareinques | 105/199 R |
| 3,143,977 | 8/1964 | Deller | 105/4 R X |
| 3,712,691 | 2/1971 | Cope | 105/199 CB |
| 3,713,398 | 1/1973 | Zupez | 308/138 X |

*Primary Examiner*—Robert J. Spar
*Assistant Examiner*—Carl Rowold
*Attorney, Agent, or Firm*—McGlew and Tuttle

[57] ABSTRACT

A truck for the pivotal support of two car bodies, particularly of articulated rail motor cars, comprises a truck frame having a vertical pivot for each car mounted in spaced longitudinal locations on the truck frame. A transversely extending swiveling bolster is centrally mounted for pivoting movement on each vertical pivot and each bolster includes a spring support adjacent each respective end for resiliently supporting the associated car body. The truck also carries slide means, such as interengaged slide plates on the truck and the bolster underlying the spring supports for slidably supporting the respective ends of the bolster on the truck.

8 Claims, 4 Drawing Figures

TRUCK FOR THE COMMON PIVOTAL SUPPORT OF TWO CAR BODIES

FIELD AND BACKGROUND OF THE INVENTION

This invention relates in general to the construction of rail vehicles and, in particular, to a new and useful truck for the pivotal support of two car bodies, particularly rail motor car bodies.

DESCRIPTION OF THE PRIOR ART

A known so-called Jacobs truck (Lueger: Lexikon der Fahrzeugtechnik, Stuttgart, 1967, p. 304) permits a kinematically quite satisfactory passing of two car bodies around plane curves, but the construction gives little possibility of an independent rolling motion to the two connected car bodies so that, where considerable super elevations occur, for example, on subways of metropolitan express railways, the derailment security is adversely affected by a strong unilateral relief of the wheels.

In another known truck (Helmut Bugarcic: "Three-part subway motor car . . .", Glasers Annalen, No. 4, 1968), two pivots are provided at a considerable longitudinal distance in connection with a common connection rod, as well as with a longitudinal link and four transverse links. Each of the two car bodies is vertically supported by a movable beam which, at both of its ends, is resiliently connected to the truck and supports the car body through slide devices comprising cooperating slide plates on the movable beam and and the car body. This arrangement permits an independent rolling motion of the car bodies and, thereby, ensures a small relief of the wheels in the super-elevation. However, due to the great longitudinal spacing of the pivots, the construction causes considerable transverse displacement of the car body ends and, thereby, prohibits the passage of travelers from one car to the other. It has further been found that the slide device does not operate without oscillations because through the springs, the movable beams are retained non-rigidly relative to the truck and, consequently, tend to follow the movements of the supported car body in the manner of a chattering motion. Additionally, considerable wear of the slide devices has occurred due partly to these oscillations and partly to the considerable relative motions caused by the distance between the slide device and the pivot and, finally, partly due to the insufficient possibility of lubrication.

SUMMARY OF THE INVENTION

The present invention is directed to a truck which avoids the drawbacks mentioned above and which permits an independent rolling motion, particularly of the two car bodies, as well as a direct passage of travelers from one car to the other.

The invention begins with the known properties of the prior art mentioned in the foregoing description, namely, that each car body is provided with its own pivot and the vertical support is ensured by a movable beam provided with a spring and a slide device at its ends.

In accordance with the invention, the movable beam is designed as a swiveling bolster rotatable about the pivot, which is supported, by its ends and through the slide devices, on the truck and supports the car body by means of the springs. This arrangement makes it possible to locate the pivots at an extremely small distance from each other. The distance must be only enough to permit an undisturbed motion of the two swivelling bolsters relative to each other. Due to this small spacing of the pivots, which is preferably less than 1000 mm, the lateral relative movements of the car ends facing each other remain very small so that a direct passage of travelers is made possible.

Since each of the swiveling bolsters is firmly guided relative to the truck by means of the pivot, it does not end to chattering motions. This applies particularly in cases where, in accordance with a further feature of the invention, the slide device is located approximately at the level of the pivot bearing. This prevents the formation of a vertical lever arm between the frictional forces acting in the slide device and the pivot bearing which could lead to torsional oscillations. For the same reason, preferably, the point of application of the spring on the swiveling bolster is also proved approximately at the level of the pivot bearing. This is particularly easy if a rubber scroll spring is used having its bolt rigidly connected to the car body. A bell accommodating the rubber scroll spring element is mounted on or in each end portion of the swiveling bolster.

The relative movements and velocities occurring in the slide device are substantially smaller than in the design of the prior art because the pivot is located substantially closer to the slide device. This further reduces the tendency to oscillations as well as to wear.

The slide device is located beneath the swiveling bolster on the truck, preferably under each bell. This results in an advantageous possibility of providing an oil bath for the slide device.

Between the swiveling bolsters and the car bodies, link rods are advantageously provided which ensure a rigid connection in the horizontal, or at least in the longitudinal direction, whereby, an independent possibility of oscillation of the swiveling bolsters can be substantially completely eliminated. Advantageously, these link rods are designed as links acting in the central line of the car or as a laterally mounted pair of links so that a force transmission from one car body to the other bypassing the spring elements is possible, for example, in the case of a collision.

Accordingly, it is an object of the invention to provide an improved truck for the pivotal support of two car bodies which includes a truck frame having vertical pivots for each car body mounted in closely spaced longitudinal locations on the truck frame and which support a transversely extending swivel bolster which is centrally mounted on the pivot for pivotal movement about the vertical axis thereof and wherein the bolster includes a spring support adjacent each end for resiliently supporting the associated car body and wherein slide means are provided on the truck underlying each spring support and slidably supporting the respective ends of the bolster on the truck.

A further object of the invention is to provide a truck, particularly for rail motor cars, which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
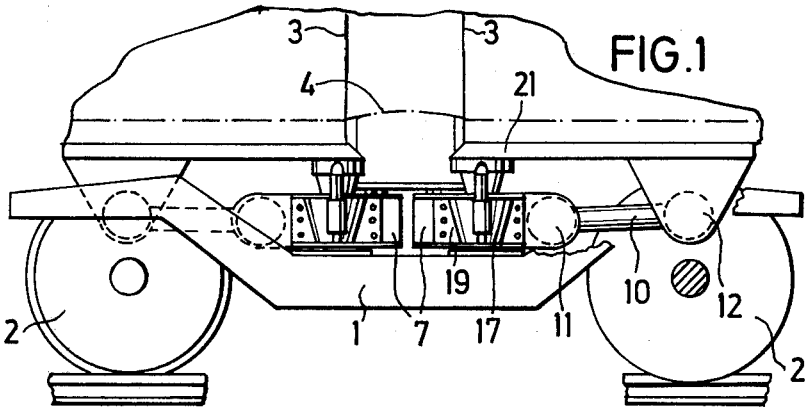
FIG. 1 is a partial side elevational view of a truck for supporting two rail passenger cars constructed in accordance with the invention.

Referring to the drawing in particular, the invention embodied therein, comprises a truck frame, generally designated 1, having wheel sets 2, 2 and provided for supporting two rail passenger car bodies 3, 3. The car bodies are enclosed at their adjacent ends by a structure 4 which permits the passage of travelers from one car body to the next.

In accordance with the invention, the truck frame is provided with two vertical pivots 5 which are spaced apart from each other by a relatively small distance, for example, from 300 to 400 mm and which are located preferably centrally of the truck frame 1. Pivots 5 and 5' are provided for pivotally supporting respective transverse members or swivel bolsters 7 and 7' for pivotally supporting respective car ends of the cars 3 and 3'. Each bolster 7 and 7' is pivotally supported on the vertical pivot 5 for pivotal movement about an axis 6 on a bearing bush 8.

Pivots 5 and 5' are rigidly connected together at their undersides by the frame 1 and at their upper or top sides by means of a tie member 9. Consequently, longitudinal forces can be transmitted without strongly stressing the two pivots in bending. A link rod 10 is centrally connected between each swiveling bolster 7 and the associated car body 3 and it is pivoted on a horizontal pin 11 to the bolster 7 and, at its opposite end, it is pivotally supported on a member 12 supported from a car body 3 or 3'. The link rod is designed so that it is capable of transmitting the longitudinal forces between the swiveling bolster 7 and the associated car body 3 without laterally stressing the spring means 16 which resiliently support each car body on the swiveling bolster. Thus, the link rods 10, the swiveling bolsters 7, on their pivots 5, and the parts of the frame 1, as well as the tie member 9 connecting the pivots, ensure a direct transmission of the longitudinal forces from one car body to the other.

Each bolster 7 and 7' is slightly angled on the side facing outwardly from the adjacent car body in order to provide for a sufficient space for angular motion of the associated car body 3 and 3'.

Figure 2:
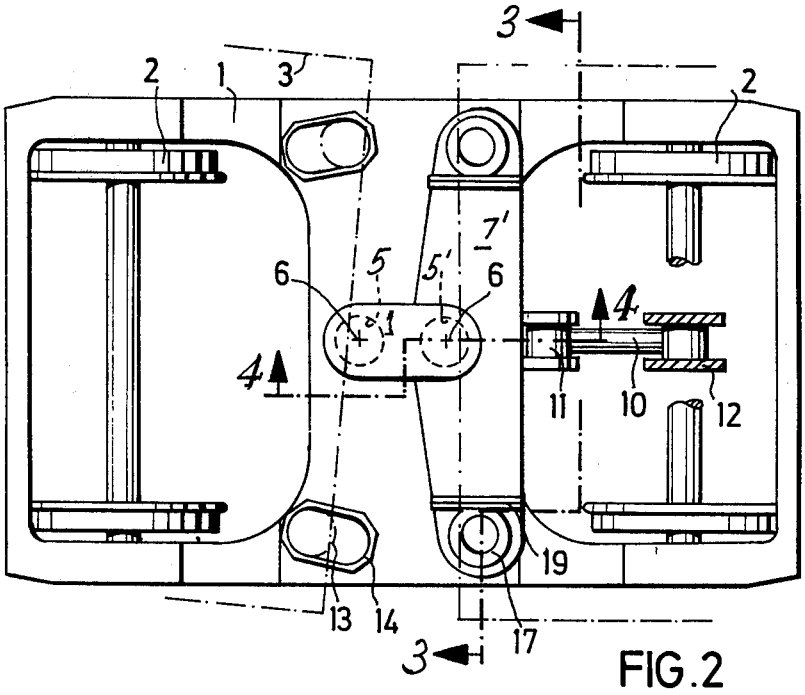
FIG. 2 is a top plan view of the truck frame with portions of the operating mechanism removed.
Figure 3:
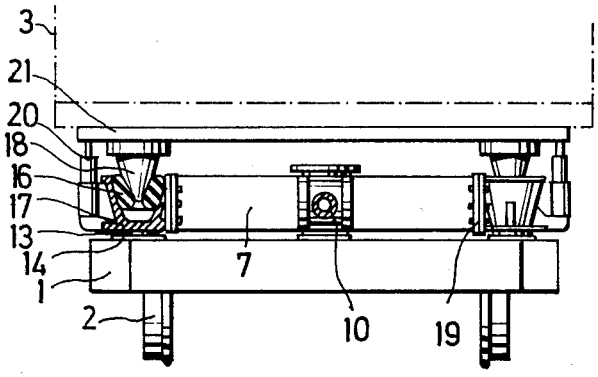
FIG. 3 is a section taken along the line 3—3 of FIG. 2.
Figure 4:
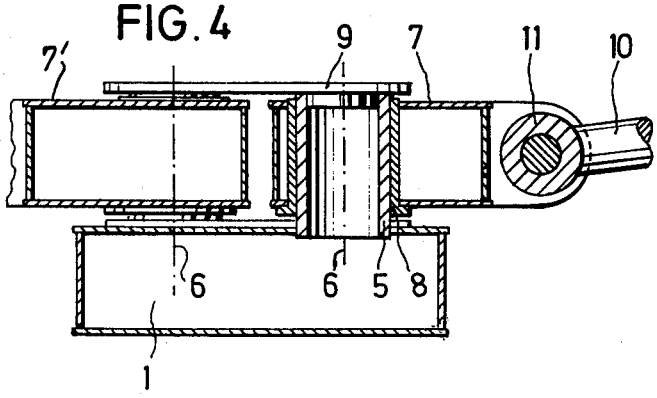
FIG. 4 is a section taken along the line 4—4 of FIG. 2.

In accordance with a further feature of the invention, each end of the bolster arm is provided with a flanged fit 19 which connects to a bell member 17 which forms an upwardly opening cavity for receiving a spring member 16 made of rubber or similar resilient material for resiliently supporting a bolt 18 of a car body. The bolt 18 is mounted, in turn, at respective ends of a projecting part or plate 21 of the car body and a bolt 18 is located at the respective sides which extend into respective cavities of the bell members 17. In accordance with another feature of the invention, the underside of each end of the swiveling bolster 7, for example, underlying the bell 17, is supported on slide means on the truck 1. The slide means include a slide plate 13 at the bolster side and a slide plate 14 on the frame side. The shape of slide plate 14, as seen in FIG. 2 in the lefthand portion, is slightly arcuate in accordance with the possible motion path of the slide plate 13 thereover which travels on the swiveling bolster 7. Plate 14 is advantageously surrounded with a rim limiting the flow of an oil bath thereon and the slide plate 13 is advantageously provided with a coating having a low coefficient of friction, such as one made of polytetrafluorethylene. The flanged connection 19 for the bell 17 makes it possible to secure the bell on its one side to the bolster and the construction makes it possible to do this without any additional vertical spacing between the parts. Thereby, the heighth of the overall structure is reduced and, at the same time, a minimum lever arm is obtained between the point of application of the bolt 18 on the associated spring 16 and the frictional surfaces of the slide devices 13 and 14 so that the generation of oscillations is rendered difficult. In the usual manner, a shock absorber 20 is provided on each side close to the spring support of the car on the bolster. The bolts 18 and the shock absorbers 20 do not apply directly against the car body but against a projecting part 21 which is firmly connected to the car body and the construction is such that split shim rings may be inserted for adjusting the car body in height following a stronger wear of the wheel rims or tires or following a resetting of the springs. The link rod or pair of link rods 10 may also be connected to the projecting part 21.

As may be easily seen in practice, there is no lateral relative motion between the ends of the car bodies 3 and 3' which face each other during any angular movement. Therefore, a sure passage for travelers may be provided over the passage space 4. In addition, it should be noted that, due to the small distances between the points of rotation at the axes 6 and 6', the motion paths of the slide devices 13 and 14 are extremely short. At an oscillatory motion of the car bodies 3 and 3', the force is transmitted from one car body to the associated swiveling bolster in an immediate vicinity of the slide devices. A notable lever arm between the area of force transmission in the rubber scroll spring 16 and a line of action of the frictional forces in the area of the slide devices 13 and 14 which could produce an oscillatory motion is thus avoided. Since the slide devices and the springs are coaxial of each other, the ends of the swiveling bolsters are never stressed in flexion. Translatory oscillations of the swiveling bolster in a horizontal plane are not possible because of its fixed position relative to the point of rotation about the axis 6. Since, in addition, the frictional conditions in the slide devices can be rendered favorable due to an oil bath, a substantially smaller wear can be expected as compared to conventional arrangements. Longitudinal forces can be transmitted from one car body 3 to the car body 3' without stressing the swiveling bolster and the spring bolts in flexion through the link rods 10 in the central line of the car. Should two lateral link rods 10 be provided instead of only a single central link rod 10, as indicated, the force transmission from one car body to the other is also possible through the link rods bypassing the spring elements.

At the same time, the construction is rugged, simple and space-saving in all directions, and a substantially better run quality factor transversely to the travel direction is to be expected than for a truck which has pivots which are spaced widely apart in the longitudinal direction. The reason for this is that the transverse shocks are directed from the truck into the car body in a kinematically more favorable manner and the transverse elasticity of the springs can produce its full effect.

While a specific embodiment of the invention has been shown and described in detail to illustrate the application of the principles of the invention, it will be understood that the invention may be embodied otherwise without departing from such principles.

What is claimed is:

1. A truck for the pivotal support of two car bodies, particularly of articulated rail motor cars, comprising a truck frame, a vertical pivot for each car body mounted in closely spaced longitudinal locations on said truck frame, a transversely extending swiveling bolster mounted intermediate its length for pivoting movement about each of said vertical pivots, spring support means adjacent each end of each of said bolsters for resiliently supporting a car body on the respective ends of respective bolsters, and slide means on said truck underlying said spring support means and slidably supporting the respective ends of said bolsters on said truck.

2. A truck according to claim 1, wherein the center lines of the vertical pivots of said bolsters are at a spacing of less than 1000 mm apart.

3. A truck according to claim 1, wherein said slide means includes a first plate secured to said frame, and a second plate secured to said bolster adjacent the location of said pivot in sliding engagement with said first plate.

4. A truck according to claim 1, wherein said spring support means comprises a bolt carried by said car and a bell fixed to respective outer ends of said bolster defining an upwardly opening cavity into which said bolt extends, said bell having a resilient spring member therein resiliently supporting said bolt.

5. A truck according to claim 4, wherein said resilient spring member comprises an annular rubber piece holding said bolt in a form closure.

6. A truck according to claim 1, wherein said slide means includes a pair of interengageable slide plates and means for providing an oil bath for the slidable engagement of said slide plates.

7. A truck according to claim 1, including a link rod connected to said bolster and to a respective car body.

8. A truck for the pivotal support of two car bodies each car body having a bottom projecting portion, particularly for supporting articulated rail motor cars, comprising a truck frame, a vertical pivot for each car body mounted in closely spaced longitudinal locations on said truck frame, a transversely extending swiveling bolster mounted intermediate its length for pivoting movement about each of said vertical pivots, spring support means adjacent each end of each of said bolsters for resiliently supporting said bottom projecting portion on said car body on the respective ends of respective bolsters, and slide means on said truck underlying said spring support means and slidably supporting the respective ends of said bolsters on said truck.

* * * * *